US005236313A

United States Patent [19]

Kim

[11] Patent Number: 5,236,313

[45] Date of Patent: Aug. 17, 1993

[54] ROTARY-TYPE VACUUM PUMP

[76] Inventor: Young-Soo Kim, #455-9, Seokyo-Dong, Mapo-Ku, Seoul 121-210, Rep. of Korea

[21] Appl. No.: 966,832

[22] Filed: Oct. 27, 1992

[30] Foreign Application Priority Data

Sep. 9, 1992 [KR] Rep. of Korea ..... 92-16574

[51] Int. Cl.[5] ..... F04B 49/00

[52] U.S. Cl. ..... 417/281; 417/295

[58] Field of Search ..... 417/281, 295, 432

[56] References Cited

U.S. PATENT DOCUMENTS 4,525,129 6/1985 Berges et al. ..... 417/281 X 4,844,702 7/1989 Ceccherini ..... 417/281

5,020,976 6/1991 Nakajima et al. ..... 417/295

*Primary Examiner*—Richard E. Gluck

*Attorney, Agent, or Firm*—Birch, Stewart, Kolasch & Birch

[57] ABSTRACT

An improved rotary-type vacuum pump includes a lubrication circuit in which an oil inlet port of an oil suction duct is directed towards the floor of the pump casing, rotors having oil spaces filled with oil between the vanes, an oil filter provided at the outside of the pump housing, and an excess pressure discharge valve immersed in the oil and being disposed at a terminating portion of the lubrication circuit. The mounting of other essential elements of the pump unit is concentrated on the front cover and the pump housing of the pump.

6 Claims, 3 Drawing Sheets

ROTARY-TYPE VACUUM PUMP

BACKGROUND OF THE INVENTION

This invention relates to an improvement in a rotary-type vacuum pump which has means for preventing contamination caused by a backward flow of oil and steam in the pump unit when the operation of the pump unit is stopped by unexpected power failure or breakdown.

In a rotary-type vacuum pump, oil is used as a sealing means for obtaining a high degree of vacuum. Also, the oil cools the pump unit and lubricates the bearings and other parts while circulating through the pump unit.

For forced circulation of the oil through the pump unit, an auxiliary lubricating pump or oil pump may be provided. When the operation of the pump unit or the supply of oil is suddenly stopped, oil and air in the pump or the oil storage casing are likely to flow backward into the pump unit due to the decrease of pressure. Thereafter, the backward flowing oil and air enter the vacuum equipment through the suction duct, thus contaminating and seriously damaging the vacuum equipment. Accordingly, a non-return valve for closing the suction duct and non-return valve control means should be provided.

A conventional non-return valve control means opens the non-return valve only when the fluid pressure through the lubrication circuit is restored. This presents a problem in that substantial time is needed for pressure restoration, and for the pump unit to re-operate.

U.S. Pat. No. 4,844,702 issued Jul. 4, 1989 discloses a solution to this problem.

This U.S. Patent relates to an improved lubrication circuit which is connected to rotary vacuum pumps and is composed of a hydraulic circuit and of the related pump unit for lubrication and auxiliary controls, including isolation of the negative pressure space from the pump upon the stopping of the latter, with the aid of a closure member.

In the lubrication circuit, the pressure of the fluid in pump discharge space is used for controlling a closure member, with the aid of two ducts connected with each other between the discharge space and a closure member operating member. The hydraulic pressure generated by lubrication pump unit is applied to the moving parts of the pump and transmitted through the pressure transmitting duct to a control member which controls the operation of the closure member.

However, the U.S. Patent has the following problems.

In the first place, the oil entry port for entry of the oil from the pump (or oil storage casing) to the pump unit is disposed high. Therefore, a slight lowering of the oil surface will cause stoppage of the oil supply. This causes non-operation of the closure member.

Secondly, since the filter net is disposed in the oil entry of the oil pump, if the filter net is clogged, substantial time is needed for repair it.

Thirdly, excess oil should be returned through the excess pressure discharge valve. However, in the U.S. patent, since oil pump and pressure discharge valve are adjacent to each other, the oil to be supplied to the lubrication circuit is likely to leak through the pressure discharge valve before being supplied to the moving parts.

Fourthly, when returned to the oil storage casing through the pressure discharge valve, oil will be sprayed by high hydraulic pressure and hit the inner face of case, thus producing noise and being discharged through the discharge port together with discharged gases. This causes waste of oil.

Fifthly, the spring mounted between vanes for making the vanes come in close contact with the inner face of the cylinder is likely to break easily due to repetitive tension and compression stress. This causes substantial cost for operating the pump unit.

SUMMARY OF THE INVENTION

To overcome the above disadvantages, the present invention provides a vacuum pump wherein, even the amount of oil in the pump casing is very small, oil is supplied to and lubricates the moving parts of the pump.

The vacuum pump according to the present invention includes the entry port of the oil suction duct through which oil is supplied to the oil being directed toward the floor of the pump casing and disposed at the lower end of the pump unit. Since the conventional oil suction port is disposed on the rotor shaft, when the oil level in the casing is below the rotor shaft, it is impossible to lubricate each part of the pump unit. Therefore, in such case, the operation of the pump should be stopped. However, in the present invention even when the oil level is lowered to the lower part of the pump body, lubrication is achieved.

Another object of the present invention is to provide a vacuum pump wherein the oil filter is easily replaced. For this purpose, in this invention, the oil filter is provided at the outside of the pump housing and the oil to be circulated is supplied to parts of the pump through the filter.

Still another object of the present invention is to provide a vacuum pump wherein oil waste and the noise produced from excess oil returned by excess pressure are prevented, and wherein enough oil is supplied to each part of the pump unit. For this purpose, in this invention, the excess pressure discharge valve of oil is mounted at the terminating portion of the lubrication circuit, and its outlet port is disposed below the level of the oil in the casing.

Yet another object of the present invention is to provide a vacuum pump wherein close contact of vanes with the inner face of the cylinder is ensured and high efficiency shock absorption is achieved when the vanes are contracted, and wherein lubrication and sealing efficiency are improved. For this purpose, in this invention, oil is supplied to the moving parts of the rotor by the pressure of the oil suplied from the oil pump and to spaces between the vanes through oil passages formed in the rotor, thus effecting shock absorption, lubrication and sealing efficiency.

BRIEF DESCRIPTION OF THE DRAWINGS

The invention will be readily understood by the following description of certain embodiments, by way of example, in conjunction with the accompanying drawings, in which.

DETAILED DESCRIPTION OF THE INVENTION

Figure 1:
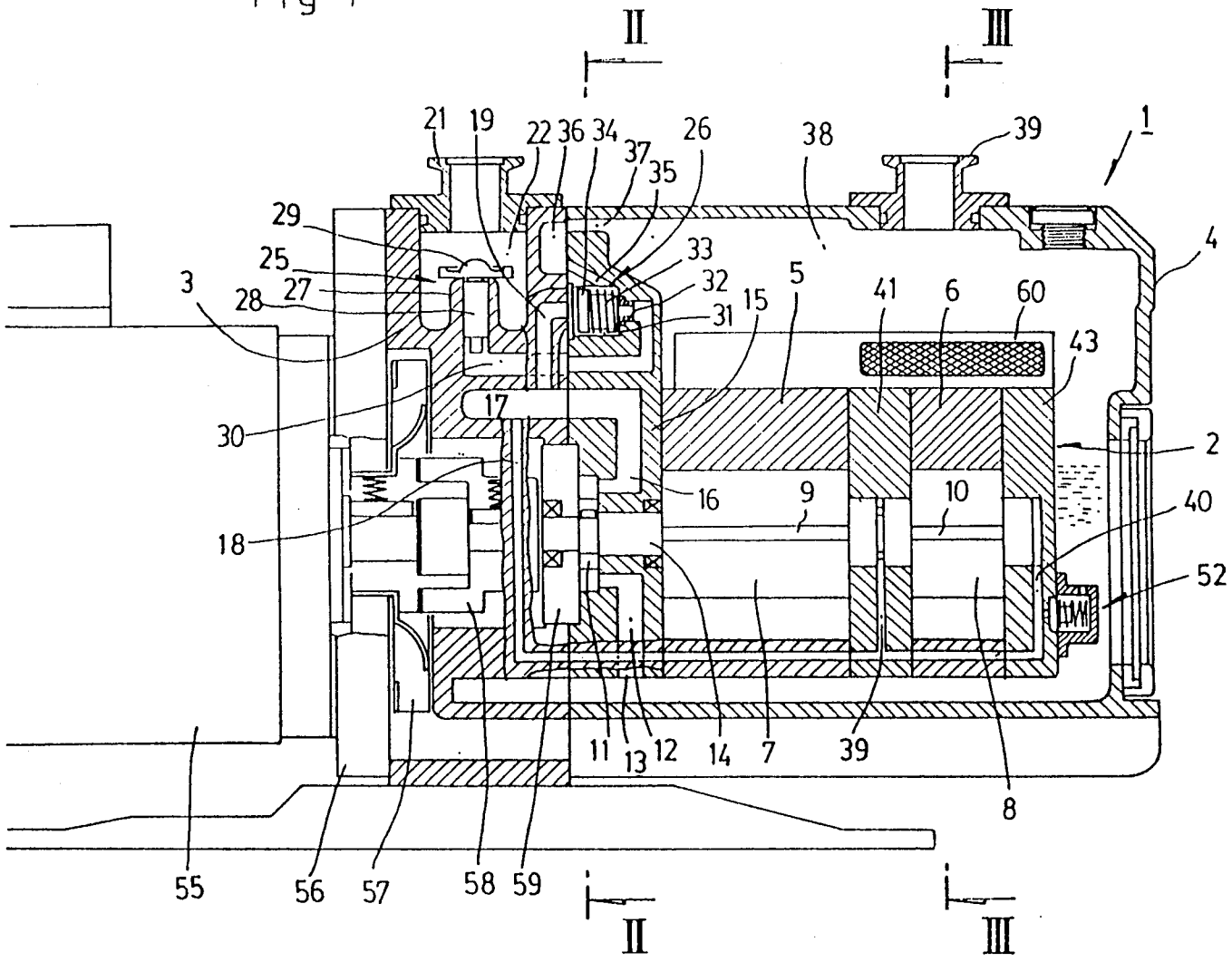
FIG. 1 is a sectional view showing the interior of the rotary-type vacuum pump of this invention.

Referring to the drawings, FIG. 1 is a sectional view showing the interior of a rotary-type vacuum pump 1. A pump unit 2 is surrounded by a housing 3 and an oil storage casing or pump casing 4 which contains large quantities of oil.

Pump unit 2 includes first and second cylinders 5, 6 and rotors 7, 8 which rotate in the cylinders 5, 6, respectively and have vane grooves for receiving two vanes 9, 9', 10, 10', respectively. The vanes rotate while closing proximately to the inner wall of the cylinders by centrifugal force produced from the rotation of the rotors 7, 8, whereby gas will be repeatedly sucked into the cylinders from a vacuum equipment (not shown), compressed in the cylinders and discharged outwards.

Without continuous supply of oil to the moving parts of the pump unit, such as cylinders or rotors of the pump unit, the moving parts will be worn out or stuck together or the pump unit will be subject to leakage, lowering the degree of vacuum substantially. In the worst case, the pump unit will be damaged. To solve the above problems, oil is supplied by a forced circulation method.

The oil contained in the oil storage casing is used to perform the function of lubrication and sealing for the moving parts of the pump. For the supply of oil to the pump unit, an oil pump 11, and a lubrication circuit or oil supplying passage are needed. The oil pump 11 should be such that it can supply the amount of oil more than sufficient for the pump unit 2. The oil pump should have good durability and generate much higher hydraulic pressure.

Inlet port 13 of an oil entry duct 12 must be directed toward the floor of the oil storage casing so that the oil in the oil storage casing 4 may be supplied to the pump unit 2 even when the amount of oil in the oil storage casing 4 is small.

The oil pump 11 is mounted to a front cover 15 which supports a rotor shaft 14. The oil pump 11 supplies oil to the moving parts through oil passages 16, 17, 18, 19 which constitute a lubrication circuit.

Figure 2:
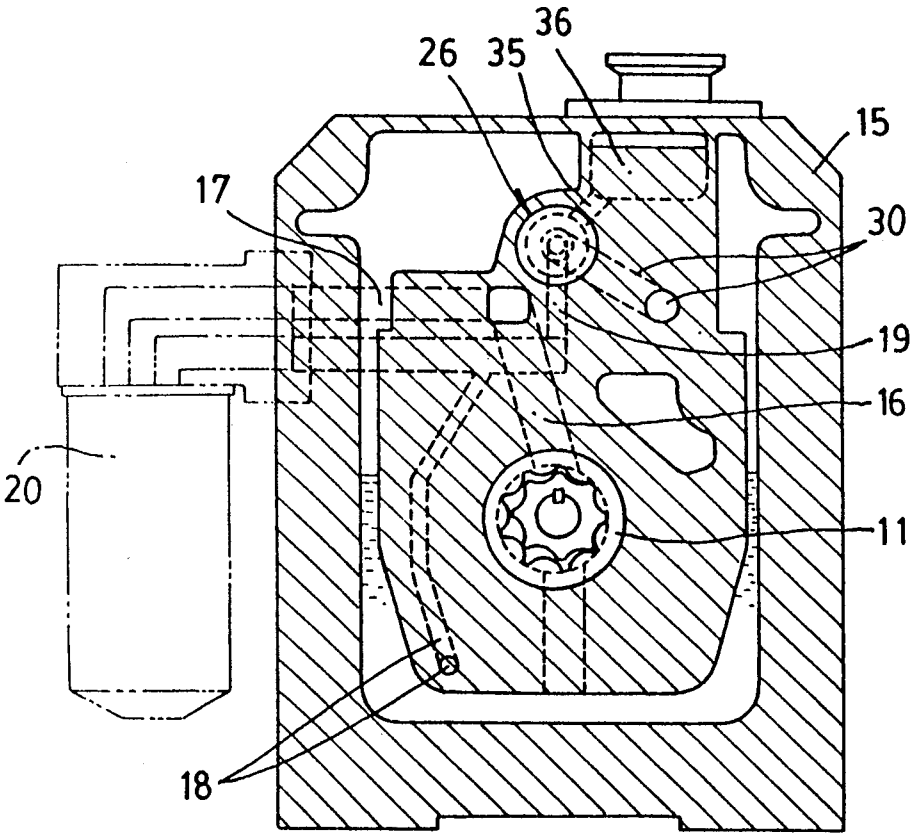
FIG. 2 is a sectional view taken along line II—II of FIG. 1 showing the oil filter connected to the lubrication circuit.

If the oil to be supplied to the moving parts of the pump unit contains foreign substances, the moving parts will be damaged and contaminated, thus deteriorating the performance of the pump unit. Therefore, filtered oil must be supplied. The mounting of an oil filter in the oil casing may make it difficult to repair and replace the filter. Therefore, as shown in FIG. 2, an oil filter 20 is disposed on the outside of the pump unit.

Pump suction nozzle 21 is provided at the upper part of the pump housing 3. The gas or oil entering the cylinders 5, 6 of the pump unit through suction chambers 22, 23 is compressed by the rotation of the rotors 7, 8 and then discharged through discharge valves 24.

When the operation of the pump unit is stopped suddenly, the oil having been used for the lubrication, contaminated gas or outside air flows backward to the inside of the pump unit, the suction chambers 22, 23 in communication with the inside of the pump unit, the suction nozzle 21 and the vacuum equipment (not shown) connected to the suction nozzle 21, thus contaminating the vacuum equpment or breaking the vacuum. Therefore, non-return valve 25 and its control means 26 are needed.

The non-return valve 25 is actuated by the oil supplied by the oil pump adapted for closing the pump suction nozzle 21 when the operation of the pump unit 2 is stopped.

The non-return valve 25 is mounted within the suction chamber 22 directly below the suction nozzle 21 and includes a cylinder 27, and a piston 28 slidable in the cylinder 27 and a valve plate 29 secured to the upper end of the piston 28. The cylinder 27 is connected to the non-return valve control means 26 through an operating passage 30, the control means 26 being provided on the front cover 15. The other end of the valve control means 26 is connected to oil passage 17 through oil passage 19.

One of the features of the present invention is that the mounting of the oil pump, lubrication circuit and non-return valve and its control means is concentrated on the pump housing and front cover, thus making the pump unit remarkably inexpensive.

The non-return valve control means 26 has a cylindrical control space 31 provided in the front cover 15. The cylindrical control space 31 is connected to vertical oil passage 19 at one end thereof and to the operating passage 30 at the other end thereof. A plug 32 is inserted in the operating passage 30.

A piston 34 supported by a compression spring 33 is mounted in the space 31 at the oil passage 19. The control space 31 is connected to an oil tank 36 through oil passage 35.

The oil tank 36 is disposed above the non-return valve control means 26 and communicated through the upper opening 37 with the upper space 38 of the oil storing casing 4. The upper space 38 is in communication with the atmosphere through a discharge port 39 so that it may be under atmospheric pressure.

Since the oil pump 11 is capable of pumping the amount of oil more than sufficient for the pump unit 2, when the pump unit 2 runs, the oil pump 11 will run simultaneously, thus supplying oil passages which constitute the lubrication circuit with the remaining oil returned to the oil storage casing. The oil pressurized by the operation of the oil pump is supplied to the moving parts of the vacuum pump unit through the oil passage 18 with some of the oil operating the piston 34 of the non-return valve control means through oil passage 19.

At this moment, since the hydraulic pressure is higher than the pressure of the compression spring 33, the piston will move while pressing the spring, thus causing opening of the plug 32 to close. With the closure of the opening of plug 32, the operating passage 30 will be separated from the control space 31.

With the continuous operation of the pump unit 2, the opening of plug 32 maintains the closed condition, and the remaining oil fills the oil tank through oil passage 35, overflows the upper opening 37 and is returned to the oil storage casing.

When the operation of the pump unit is stopped, the hydraulic pressure within each oil passage decreases suddenly. With the sudden decrease of the pressure, the piston of the non-return valve returns to its original position by the pressure of the compression spring while cutting off oil passage 19 from the control space and opening the plug. Accordingly, oil tank, oil passage 35 and operating passage 30 will communicate with one another.

While suction chamber 22 forms a vacuum, oil storing tank 36 is under atmospheric pressure. By the pressure difference between the chamber 22 and the oil storing tank 36, the oil in the tank 36 will flow through oil passage 35 and operating passage 30, and drive the piston 28 upwards until the valve plate 29 comes in close contact with the lower end of the suction nozzle 21, to close the nozzle 21. With the closing of the nozzle 21, vacuum equipment (not shown) connected to the suction nozzle will be cut off from the pump unit.

In case the vacuum equipment is not cut off from the pump unit, the oil entering the pump unit will return, by the pressure difference, to the vacuum equipment through suction chambers and nozzle, thus contaminating the equipment and allowing the entry of outside air. Therefore, the vacuum will be broken. For preventing the vacuum break, the vacuum equipment should be cut off from the pump unit. The clearance must be large enough to permit the up and down movement of the piston 28 in the cylinder 27. In this invention the clearance is large enough to permit the oil and air to pass, which facilitates the manufacturing of the pump unit of the present invention and makes the pump unit rather inexpensive.

After non-return valve piston 28 is raised and valve plate 29 closes the suction nozzle, the oil and gas in the oil storage tank will pass through the clearance and enter the inside of the vacuum pump cylinder under a vacuum, thus putting the inside of the pump cylinder under atmospheric pressure. Accordingly, non-return valve plate 29 will further come in close contact with the suction nozzle. The oil having entered the pump unit will be returned to the casing 4 through discharge valve 24 after being used for lubrication and airtightness when the pump unit is operated again.

The non-return valve control means 26 is desired to be disposed adjacent to the non-return valve for easy operation. The adjacent arrangement allows the non-return valve to actuate in a short time. After the plug 32 is closed by the piston 34 during the operation of the pump unit, the air under atmospheric pressure in the operating passage 30 should pass through the clearance between piston 28 and cylinder 27, enter the cylinder of the pump unit and then be discharged outwards. If the distance between the non-return valve and the valve control means is large (that is, when the length of operating passage 30 is large), substantial time is required for evacuating operating passage 30 and the suction chamber.

The evacuation of operating passage 30 will bring about lowering of the piston of non-return valve by means of gas pressure which enters the suction chamber from the vacuum equipment through the pump suction nozzle, thus opening pump suction nozzle 21, while shutting off the operating passage from suction chamber 22 by the close contact of valve plate 29. After these processes, normal vacuum operation will be performed.

Numerals 55, 56, 57, 58, 59, 60 designate, respectively, a driving motor, a motor housing, a cooling fan, a shaft coupling; an oil pump fixing plate, and a discharge valve cover.

FIG. 2 is a sectional view taken along lines 2—2 of FIG. 1, which shows that oil is being supplied through exterior oil filter 20 while the oil entering through oil entry duct 12 during running of oil pump 11 is circulating through oil passages 16, 17, 18, 19 constituting a lubrication circuit. The mounting of the oil filter at the outside of the pump unit facilitates replacement and repair thereof.

Figure 3:
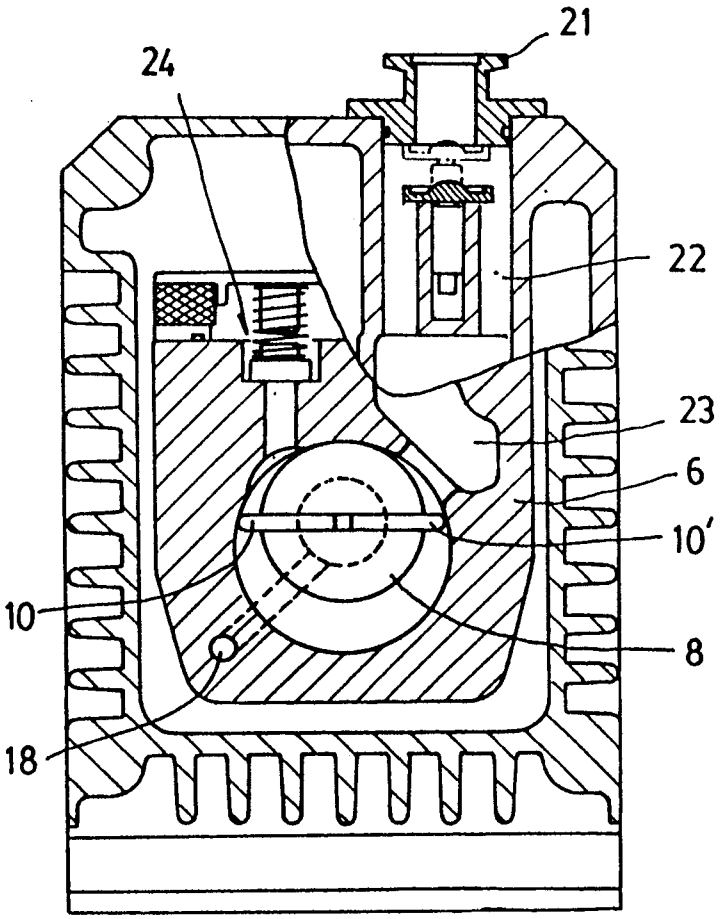
FIG. 3 is a sectional view taken along line III—III of FIG. 1 showing the inlet and outlet of gases.

FIG. 3 shows a sectional view showing that, when rotor 8 rotates, gas is sucked into the cylinder from vacuum equipment (not shown) through suction chambers 22, 23 and nozzle 21, compressed in the cylinder and then discharged outwards.

Figure 4:
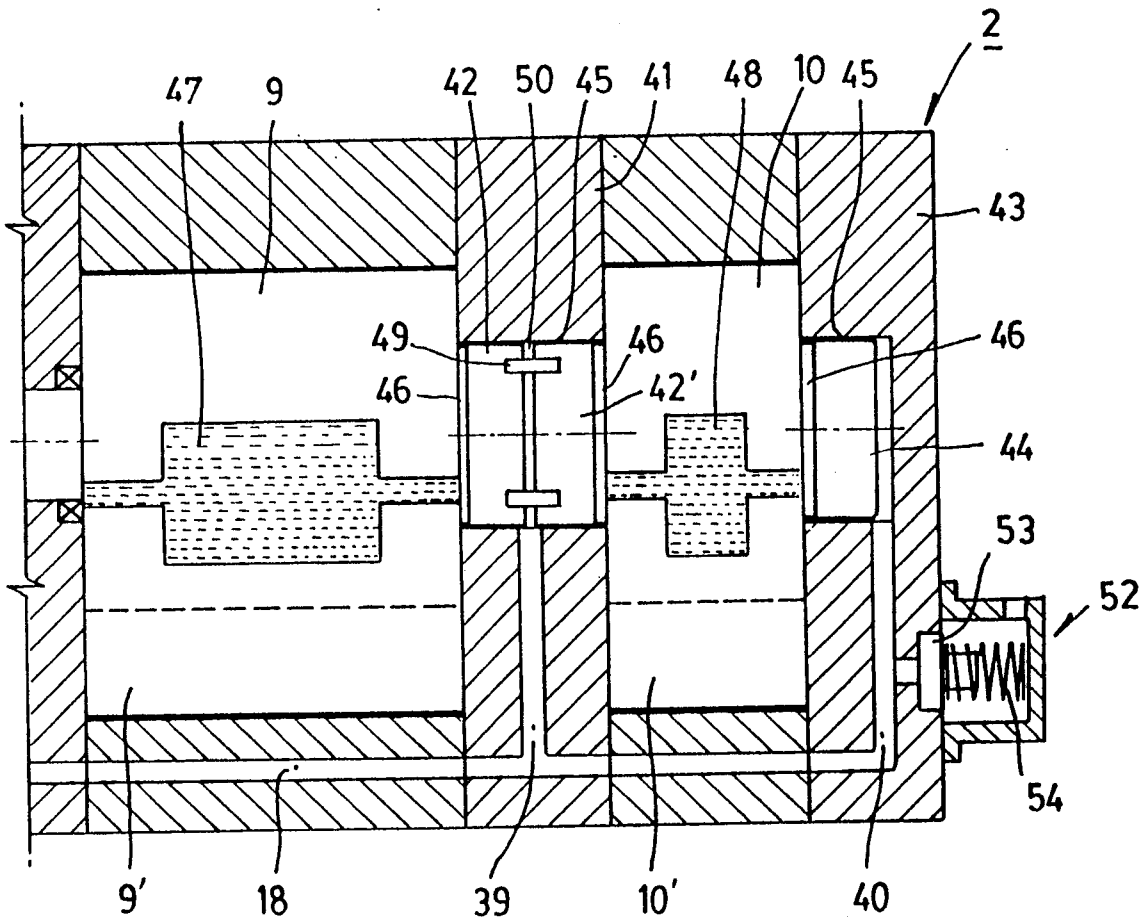
FIG. 4 is an enlarged view of the pump of the present invention.

FIG. 4 shows a detailed sectional view showing that oil is supplied to and lubricates the moving parts and then supplied to a space between vanes 9, 9', 10, 10'.

The oil supplied by oil pump 11 is supplied through passages 18, 39, 40 to sliding parts of rotor shafts 42, 42' supported by middle plate 41, and of rotor shaft 44 supported by rear cover 43. Thereafter, the oil enters the spaces 47, 48 between vanes through clearances 45, 46 of the moving parts.

The clearance 45 should be within a permitted tolerance when the engagement of the shaft and hole is made. One axial groove or two horizontal grooves may be provided for facilitating oil supply.

The first and second rotors 7, 8 are made of two sections connected together by two pins 49 for assembly to the first and second cylinders 5, 6. Therefore, oil fills the space 50 between opposite rotor shafts 42, 42' supported by middle plate 41 and the space 51 between rear cover 43 and rotor shaft 44, thus being supplied around the rotor shafts 42, 42'.

Clearance 46 is a passage which is formed by making the width of vane grooves larger than that of the vanes.

When the rotor rotates, vanes will rotate while contacting closely with the inner wall of the cylinder by the centrifugal force. At this time, two vanes will move toward and away from each other. This will cause substantial friction between the vane grooves and the wall of the cylinder.

Accordingly, the oil in chambers 47, 48 which are provided between two vanes serves to absorb shock when the vanes contract and approach each other. At this time, the oil is under compressive force and supplied to the moving parts through clearances, thus facilitating lubrication and sealing. The oil entering the cylinder is discharged together with gases and returned to the oil storage casing.

Since the amplitude of the space between two vanes is about 2–3 mm, the remainder of the oil having been supplied to the moving parts during the contraction of the vanes cannot help being discharged to oil passages 39, 40 through clearances 45, 46.

However, since the oil pump supplies an amount of oil much more than sufficient for the pump unit 2, a sudden increase in pressure during contraction of vanes might damage the pump unit 2.

For preventing the sudden increase in pressure, the remainder of the oil having been used should be returned. For return of the oil, an excess pressure discharge valve 52 diverges from oil passage 40 of rear cover 43. The excess pressure discharge valve 52 includes piston 53 which opens and closes the oil passage depending upon the change of oil pressure. The piston 53 is supported by compression spring 54. The valve 52 is desired to be disposed adjacent to the terminating portion of the lubrication circuit and below the level of the oil in the oil storage casing.

The excess pressure discharge valve is immersed in oil when operating, thus preventing noise from being produced when the oil under high pressure is exhausted through the valve, and preventing the oil from being lost outwards together with exhaust gases.

What is claimed is:

1. A rotary-type vacuum pump comprising:

a pump unit having first and second cylinders and first and second rotors for rotating in the cylinders, whereby gas is sucked into the cylinders, compressed in the cylinders and discharged outwards through a discharge valve;

an oil storage casing for protecting the pump unit, the oil storage casing being in communication with the atmosphere through a gas discharge port and containing oil to be supplied to moving parts and attached parts of the pump unit;

a pump housing for cooperating with the oil storage casing for storing oil in the casing, the pump housing having a pump suction nozzle and pump chambers for sucking gas into the cylinders;

a front cover disposed between the pump housing and the pump unit for supporting shafts of the rotors;

an oil pump mounted on the rotor shafts for supplying oil to the pump unit and the attached parts controlling the pump unit, the rotor shafts being formed through the front cover;

a lubrication circuit having an oil suction duct having an inlet port for supplying oil to the pump unit, the inlet port being directed toward the floor of the oil storing casing;

an oil filter mounted at the outside of the pump housing for providing purified oil from the oil pump;

a non-return valve mounted at the lower end of the pump suction nozzle for closing the pump suction nozzle for preventing oil and gas from flowing backward when operation of the pump unit is stopped;

a non-return valve control means mounted at the front cover for maintaining an operating passage as short as possible for shortening the time needed for evacuating the operating passage of the non-return valve when the pump unit re-operates, the non-return valve control means opening the operating passage of the non-return valve when the operation of the pump unit is stopped and shortening operating response time of the non-return valve;

a rear cover supporting the terminating ends of the rotor shafts; and an excess pressure discharge valve mounted at the lower end of the rear cover for returning to the oil storage casing the remainder of the oil having been supplied from the oil pump.

2. A rotary-type vacuum pump according to claim 1, wherein the first and second rotors have an oil storage space for storing oil supplied from the oil pump provided between two vanes movable in vane grooves.

3. A rotary-type vacuum pump according to claim 1, wherein the excess pressure discharge valve is immersed in the oil in the oil storage casing.

4. A rotary-type vacuum pump according to claim 2, wherein an oil storage tank is mounted at the pump housing at a level higher than that of the non-return valve for supplying oil through the operating passage for raising the non-return valve.

5. A rotary-type vacuum pump according to claim 4, wherein during the operation of the oil pump the non-return valve control means closes the operating passage, and the oil induced from the oil pump is returned to the oil storage casing after filling the oil storage tank and wherein, when the operation of the oil pump is stopped and the operating passage is opened, the oil in the oil storage tank raises the non-return valve, thus closing a pump suction port by potential energy difference from that of the non-return valve and by circumferential pressure difference, whereby oil and air in the oil storage casing enter the cylinders of the pump unit through clearance between a piston and a cylinder of the non-return valve.

6. A rotary-type vacuum pump according to claim 5, wherein mounting of the lubrication circuit or oil passage from the oil pump, the non-return valve and the non-return valve control means are concentrated on the front cover and the pump housing.

* * * * *